US005272458A

United States Patent [19]

Hoffman et al.

[11] Patent Number: 5,272,458

[45] Date of Patent: Dec. 21, 1993

[54] SOLENOID ACTUATOR

[75] Inventors: Jerzy Hoffman, Marina Del Rey; Krzysztof J. Ciezarek, Sherman Oaks, both of Calif.

[73] Assignee: H-U Development Corporation, Santa Monica, Calif.

[21] Appl. No.: 425,499

[22] Filed: Oct. 17, 1989

Related U.S. Application Data

[63] Continuation of Ser. No. 225,236, Jul. 28, 1988, abandoned.

[51] Int. Cl.[5] ..... H01H 9/00

[52] U.S. Cl. ..... 335/179; 335/229; 335/230; 335/78

[58] Field of Search ..... 335/229, 230, 234, 274, 335/78, 79, 81, 179

[56] References Cited

U.S. PATENT DOCUMENTS

| | | | |
|---|---|---|---|
| 2,915,681 | 12/1959 | Troy . | |
| 3,142,784 | 7/1964 | Bloomfield . | |
| 3,218,523 | 11/1965 | Benson | 335/234 |
| 3,484,729 | 12/1969 | Adams . | |
| 3,504,315 | 3/1970 | Stanwell . | |
| 3,859,547 | 1/1975 | Massie | 335/234 X |
| 3,886,507 | 5/1975 | Johnston et al. | 335/234 |
| 4,122,420 | 10/1978 | Brown . | |
| 4,150,348 | 4/1979 | Foltz . | |
| 4,259,653 | 3/1981 | McGonigal | 335/230 |
| 4,316,167 | 2/1982 | Koehler | 335/234 X |
| 4,494,098 | 1/1985 | Haneda et al. | 335/234 X |
| 4,533,890 | 8/1985 | Patel | 335/234 |
| 4,782,315 | 11/1988 | Bataille et al. | 335/234 |
| 4,795,994 | 1/1989 | Hoffman . | |

FOREIGN PATENT DOCUMENTS

| | | |
|---|---|---|
| 0170894 | 5/1989 | European Pat. Off. . |
| 1614727 | 12/1970 | Fed. Rep. of Germany . |
| 2033378 | 1/1972 | Fed. Rep. of Germany . |
| 958501 | 6/1960 | United Kingdom . |

*Primary Examiner*—Leo P. Picard
*Assistant Examiner*—Raymond Barrera
*Attorney, Agent, or Firm*—Skjerven, Morrill, MacPherson, Franklin & Friel

[57] ABSTRACT

A solenoid actuator having a slider element with a permanent magnet is provided. When the electromagnet is activated, the electromagnet repels the permanent magnet, moving the permanent magnet of the slider toward a second position under the influence of a mass of ferromagnetic material located adjacent the second position. In a preferred embodiment, the poles of the slider permanent magnet are co-axially aligned with the coil and core of the electromagnet. In an alternative embodiment, the mass of ferromagnetic material may be eliminated.

5 Claims, 2 Drawing Sheets

SOLENOID ACTUATOR

This is a continuation of application Ser. No. 07/225,236 filed on Jul. 28, 1988, now abandoned.

BACKGROUND OF THE INVENTION

1. Field of the Invention

This invention relates to solenoid actuators for switches and other electrical devices.

2. Description of Related Art

Although there have been many recent advances in the technology related to all-electronic switching devices, electromagnetic actuators are still required in many applications for which all-electronic devices are not suitable. As a result, there is a need for reliable electromagnetic actuators, particularly in applications where the device is subject to vibration, high impact, high acceleration, and fluctuating thermal and humidity conditions.

In the past, electromagnetic switching devices such as relays which were capable of withstanding these adverse conditions, have often been internally complex. As a result, many such prior devices are expensive and difficult to manufacture. For example, a typical prior relay is a model 412K Series T0-5 Relay manufactured by the Teledyne Corporation. This relay includes a clipper type armature having two small push pins with an insulating glass bead to push a contact reed from a first position to a second position when the electromagnetic force attracts the armature, and a larger return spring to push the armature to its first position when the electromagnet is deactivated. The construction of the armature as well as the complex arrangement of its contact members makes this relay difficult to manufacture. This design also has a relatively high number of moving parts and welded joints which are subject to failures. As a result, the reliability of this relay limits its usefulness in many applications.

Another previous design replaces the spring and armature system with a bar-shaped slider actuator which is mechanically coupled to the contact reed. The slider is provided with an off-axis permanent magnet which is normally attracted to the yoke and core of the electromagnet; thus, holding the slider and the contact reed in a first position. Activation of the electromagnet repels the permanent magnet moving the slider and the reed to a second position. Although an improvement over the aforementioned T0-5 relay, this design has a single stable position and consumes a substantial amount of power to repel the permanent magnet.

In still another design, an armature made of a ferromagnetic material is positioned below an electromagnet. To increase resistance to shock and vibration, a permanent magnet is located such that the armature is held in one position by the attractive force of the permanent magnet. When the electromagnet of the actuator is activated, the attractive force of the electromagnet overcomes that of the permanent magnet, moving the armature to a second position. Such a design also consumes substantial power to overcome the permanent magnet.

SUMMARY OF THE INVENTION

It is an object of the present invention to provide an improved solenoid actuator obviating for practical purposes, the above mentioned limitations, particularly in a manner requiring a relatively uncomplicated mechanical arrangement.

It is a further object to provide a solenoid actuator that is highly reliable, simple in construction, relatively inexpensive to manufacture, and is able to withstand the environmental conditions typical in applications requiring such actuators.

An actuator in accordance with a preferred embodiment of the present invention includes a slider having a permanent magnet co-axially positioned below the core of an electromagnet. The slider is coupled to the element to be actuated and is held in a first position by the attractive force of the permanent magnet for the electromagnet. When the electromagnet is activated, the electromagnet repels the permanent magnet, moving the slider and the actuated element to a second position. In a preferred embodiment, the actuator further includes a mass of ferro-magnetic material located adjacent the second position. Once the electromagnet is activated the attraction of the slider permanent magnet for the ferro-magnetic mass combines with the repulsive force of the electromagnet to move the slider to the second position. It has been found that such an arrangement reduces the amount of repulsive force required of the electromagnet and hence reduces power consumption of the actuator. Furthermore, the mass of ferromagnetic material may be sized so as to retain the slider in the second position after the electromagnet is deactivated, providing a second stable position.

Further advantages and structure will be better understood in view of the detailed description below and the accompanying drawings.

DETAILED DESCRIPTION OF THE DRAWINGS

Figure 1:
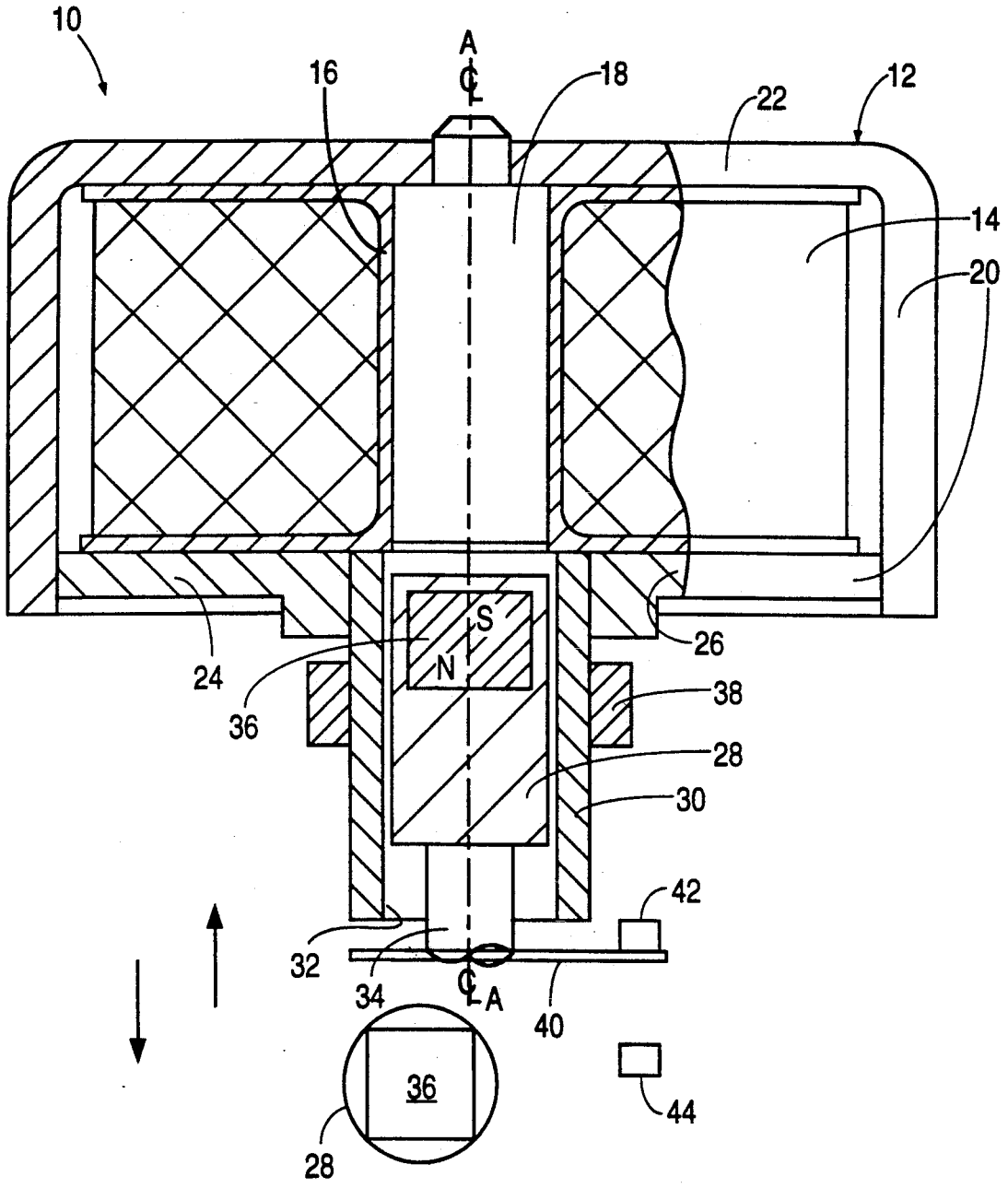
FIG. 1 is a cross-sectional view of a solenoid actuator in accordance with one embodiment of the present invention, illustrating the position of the slider in the electromagnet deactivated mode.
Figure 2:
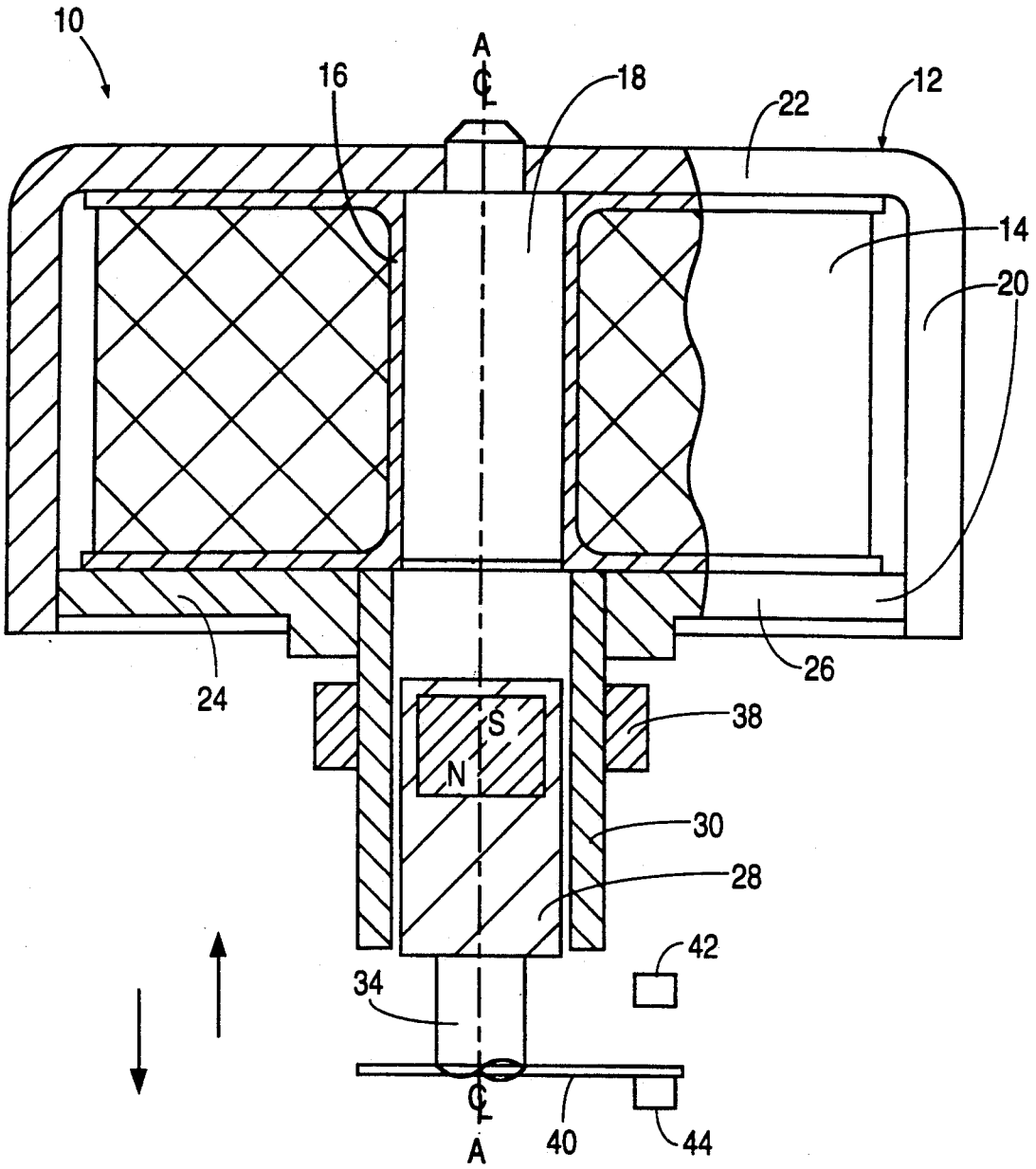
FIG. 2 is a cross-sectional view of the actuator shown in FIG. 1, illustrating the position of the slider in the electromagnet activated mode.

FIGS. 1–2 show a solenoid actuator 10 in accordance with a preferred embodiment of the present invention. The actuator 10 is shown in cross-section, the actuator being generally symmetrical about a center axis A—A. The actuator 10 may be used to actuate any of a number of electromechanical devices including RF and DC relays and reed switches and RF attenuators, power dividers and the like.

The actuator 10 includes an electromagnet 12 having a wire coil 14 wound around a generally cylindrical bobbin 16. Centered within the coil 14 is a core 18 made of a ferro-magnetic material. Completing the magnetic circuit is a yoke 20, also of ferro-magnetic material. The yoke 20 includes an inverted U-shaped bracket member 22 coupled to the core 18 at one end of the coil 14 and a pair of longitudinal radial members 24 and 26 extending from the ends of the bracket member 22 inward towards the center of the other end of the coil 14 as shown in FIGS. 1 and 2.

In order to actuate the conductor reed or other movable element of a relay or other electrical devices, the actuator 10 further has a slider 28 which is adapted to move along the center axis A—A within a bushing 30. In the illustrated embodiment, the outer surface of the slider 28 and the inner surface 32 of the bushing 30 are cylindrically shaped with the outer diameter of the slider 28 being sized somewhat smaller than the inner diameter of the bushing 30 to allow free axial movement of the slider 28 within the bushing 30. It is recognized, of course, that the slider 28 may have other shapes as well. In addition, the bushing 30 may be omitted and the guiding function performed by the body of the device, for example.

A probe 34 couples the slider 28 to the movable member to be actuated. In the illustrated embodiment, the probe 34 is fabricated from a non-magnetic insulative material so that the probe 34 can directly engage electrically conductive members such as reed conductors, if desired.

Embedded within the slider 28 is a permanent magnet 36. The horizontal cross-sectional shape of the magnet 36 is square but other shapes such as round are also useable. As represented by the symbols "N" and "S", the north and south poles of the magnet 36 are coaxially aligned with the center axis A—A of the coil and core of the actuator electromagnet. When the coil 14 of the electromagnet 12 is de-energized, that is, deactivated, the permanent magnet 36 is attracted to the core 18 of the electromagnet 12, thereby moving the slider 28 to the "first" position of the actuator 10 illustrated in FIG. 1. In this manner, the movable element coupled to the slider 28 by the slider probe 34 is maintained in a "first" position corresponding to the first position of the slider 28 illustrated in FIG. 1.

Upon energization of the electromagnet, the electromagnet exerts an axial electromagnetic force on the permanent magnet 36 of the slider 28, repelling the permanent magnet 36 away from the core 18 of the electromagnet, and moving the slider 28 axially to the "second" position illustrated in FIG. 2. In order to further minimize the amount of repulsing force (and hence electrical power) required by the electromagnet, the actuator 10 of the illustrated embodiment further includes a mass 38 of soft ferro-magnetic material positioned generally adjacent to the second position of the slider 28. The permanent magnet 36 of the slider 28 is attracted to the ferro-magnetic mass 38 and this attractive force combines with the repulsive force supplied by the electromagnet to move the slider 28 to the second position of FIG. 2. In this manner, the movable element coupled to the slider 28 by the probe 34 is actuated to a second position.

In the illustrated embodiment, the ferro-magnetic mass 38 is shaped generally as an annular ring and is positioned equidistant about the center axis A—A. It is recognized, of course, that the mass 38 may have other shapes as well. In one embodiment, the ferromagnetic mass 38 is sized and positioned such that, in the second position of FIG. 2, the attractive force of the permanent magnet 36 for the core 18 and yoke 20 of the electromagnet 12 exceeds that of the attraction to the ferromagnetic mass 38. Consequently, upon deactivation of the electromagnet, the slider 28 returns to the first position illustrated in FIG. 1. In such an arrangement, the actuator 10 would be considered to be "normally" in the first position.

Alternatively, the size of the ferro-magnetic mass 38 may be increased such that the attraction of the permanent magnet 36 for the ferro-magnetic mass 38 exceeds that of the attraction for the core 18 and yoke 20 of the electromagnet when the slider 28 is in the second position of FIG. 2. Consequently, upon deactivation of the electromagnet, the slider 28 will remain in the second position. In this arrangement, the actuator 10 would be considered to be bi-stable, that is, having two stable positions. To move the slider 28 back to the first position of FIG. 1, the electromagnet can be reactivated with the current through the coil 14 being reversed, thereby reversing the poles of the electromagnet. As a result, the permanent magnet 36 of the slider 28 is also attracted to the electromagnet by the electromagnetic force exerted by the electromagnet, overcoming the attraction of the permanent magnet 36 for the ferromagnetic mass 38. Alternatively, a second coil (not shown) with a winding in the opposite direction from that of the coil 14 could be activated.

In still another alternative embodiment, the ferromagnetic mass 38 can be eliminated. Such an arrangement has been found to operate quite satisfactorily. However, the consumption of power by the electromagnet is somewhat increased by the elimination of the mass 38.

Preferably, the range of permissible motion of the movable element coupled to the slider 28 is restricted so that the slider 28 is prevented from coming into contact with the electromagnet 12 when the slider 28 is in the first position of FIG. 1. Such an arrangement also reduces the amount of power needed to subsequently move the slider 28 to the second position of FIG. 2. In a similar fashion, the second position of the slider 28 of FIG. 2 may be defined by restricting the range of motion of the movable element towards its second position. For example, a movable element such as a reed conductor 40 may alternately engage two contact terminals 42 and 44 which define the first and second positions and hence the range of motion of the reed conductor 40. Because the slider 28 is coupled to the reed conductor 40 by the slider probe 34, the first and second positions of the slider 28 are defined by the first and second positions of the conductor reed 40. Consequently, the actuator 10 is self-adjusting. That is, the slider 28 will always move the reed conductor 40 into solid engagement with one of the two contact terminals, ensuring a good electrical connection between the reed conductor and the associated terminal.

It should be further appreciated from the above that the actuator 10 has only one moving part, the slider 28, apart from the movable element being actuated. As a consequence of the minimum number of moving parts, the reliability of the actuator 10 is increased. Furthermore, the ease of manufacture is increased with a corresponding decrease in the cost of manufacture. Still further, it is believed that the actuator 10 of the illustrated embodiment is capable of actuating at higher speeds than many prior actuators. The simplicity of the design also provides a high resistance to degradation caused by the environmental extremes of shock, acceleration, vibration, temperature and humidity.

It will, of course, be understood that numerous modifications of the present invention, in its various aspects, will be apparent to those skilled in the art, some being apparent only after study and others being matters of routine electromechanical design. For example, other shapes and sizes may be used other than those depicted. Other modifications and variations are also possible, with their specific designs being dependent upon a particular application. As such, the scope of the invention should not be limited by the particular embodiments described above, but should be defined instead by the appended claims and equivalents thereof.

We claim:

1. An actuator comprising:

a first contact terminal;

a second contact terminal;

a reed conductor having a portion situated between said first and second contact terminals and movable between a first position wherein the reed conductor contacts the first contact terminal and a second position wherein the reed conductor engages the second contact terminal;

a slider including a permanent magnet, the slider being coupled to the reed conductor, said slider being movable in a path of travel between a first position defined by engagement of the reed conductor with the first contact terminal and a second position defined by engagement of the reed conductor with the second contact terminal; and an electromagnet having a ferro-magnetic core coaxially aligned with the poles of the slider permanent magnet and the path of travel of the slider to attract the slider permanent magnet to the first position, and to repel the permanent magnet of the slider with a magnetic field when the electromagnet is activated, to thereby move the slider permanent magnet to the second position, wherein the motion of the slider is limited by engagement of the reed conductor with the first and second contact terminals such that the slider is spaced from the the electromagnet in either the first or second positions.

2. The actuator of claim 1 further comprising a mass of ferro-magnetic material positioned adjacent the second position to attract the permanent magnet to the second position.

3. The actuator of claim 2 wherein the ferro-magnetic mass is in a position spaced from the axis of the slider permanent magnet and the slider path of travel.

4. The actuator of claim 3 wherein the ferro-magnetic mass is configured as an annular ring and is positioned co-axially with the slider such that in the second position the slider is received within the aperture of the annular ring.

5. An actuator for actuating a movable element between a first position in engagement with a first contact terminal and a second position in engagement with a second contact terminal, comprising:

a body defining a channel;

a slider including a permanent magnet, the slider being coupled to the movable element, the slider being movable within the channel to define a path of travel between the first position and the second position, an electromagnet having a core of ferromagnetic material positioned to attract the permanent magnet to the first position when the electromagnet is deactivated, and the repel the permanent magnet of the slider when the electromagnet is activated; and a mass of ferro-magnetic material positioned adjacent the second position to attract the permanent magnet;

wherein the slider is moved to the second position by the repulsion of the permanent magnet by the electromagnet when activated and the attraction of the ferro-magnetic mass; and further wherein the first and second contact terminals are positioned so that the motion of the slider is limited by engagement of the movable element with the first and second contact terminals.

* * * * *